US012369727B2

(12) United States Patent
Huang

(10) Patent No.: US 12,369,727 B2
(45) Date of Patent: Jul. 29, 2025

(54) ONE-HANDED FOLDING BED

(71) Applicant: Xiaoping Huang, Fujian (CN)

(72) Inventor: Xiaoping Huang, Fujian (CN)

( * ) Notice: Subject to any disclaimer, the term of this patent is extended or adjusted under 35 U.S.C. 154(b) by 127 days.

(21) Appl. No.: 18/314,040

(22) Filed: May 8, 2023

(65) Prior Publication Data

US 2024/0341498 A1 Oct. 17, 2024

(30) Foreign Application Priority Data

Apr. 11, 2023 (CN) ..... 202320791957.7

(51) Int. Cl.
*A47D 7/00* (2006.01)

(52) U.S. Cl.
CPC ..... *A47D 7/002* (2013.01)

(58) Field of Classification Search
CPC .... A47D 13/063; A47D 13/061; A47D 7/002; A47D 13/06; A47D 9/016; A47D 13/00; A47D 13/066; A47D 13/068; A47D 15/001; A47D 7/00; A47D 13/10; A47D 9/00; Y10T 403/32393; Y10T 403/32409; A47C 19/122; B62B 2205/02; B62B 2205/06; B62B 7/06; B62B 3/02; F16C 11/04; F16C 2314/70
USPC ..... 5/99.1, 93.1, 102, 98.1; 403/102
See application file for complete search history.

(56) References Cited

U.S. PATENT DOCUMENTS 4,811,437 A * 3/1989 Dillner ..... A47D 13/063 5/99.1
2010/0260536 A1* 10/2010 Yu ..... A47D 13/063 5/99.1
2022/0279938 A1* 9/2022 Mountz ..... A47D 13/063

FOREIGN PATENT DOCUMENTS

CN 1132542 C * 12/2003 ..... A47D 13/063
EP 1199011 A1 * 4/2002 ..... A47D 13/063
GB 2553886 A * 3/2018 ..... A47D 13/063

OTHER PUBLICATIONS

"Adopt." Vocabulary.com, Dictionary, Definition 5, https://www.vocabulary.com/dictionary/adopt (Year: 2012).*
"Pull." The Free Dictionary, Dictionary, Definition 1, https://www.thefreedictionary.com/pull (Year: 2022).*
"Symmetrical." Merriam-Webster, Dictionary, Definition 2, www.merriam-webster.com/dictionary/symmetrical (Year: 2022).*

* cited by examiner

*Primary Examiner* — Madison Emanski

(57) ABSTRACT

A one-handed folding bed comprises a bed frame main body enclosed by a peripheral framework, and the main body comprises an upper frame, a lower frame, and intermediate upright poles supporting the upper frame and the lower frame. The upper frame adopts a square frame enclosed by dual longitudinal rods, with each side connected by foldable connectors to connect the four corners. The lower frame is provided with intersecting rods, and a pull-up movable connector is connected between the intersecting rods. The invention employs mechanical connectors for the fastening and unfastening process when folding and unfolding, with a simple structure and a rational design without rope actuation. During operation, the pull strap can be lifted by only one hand to drive the pull-up movable connector for unfastening, completing the folding operation with a smooth unfastening process and convenient one-handed action.

8 Claims, 10 Drawing Sheets

ONE-HANDED FOLDING BED

1. TECHNICAL FIELD

The invention related to the field of folding fabric beds, in particular to a folding bed that can be quickly folded or unfolded by one-handed operation.

2. BACKGROUND ART

An infant crib or play bed, as one of the essential auxiliary tools for taking care of infants, is typically designed to be foldable to improve its convenience. On the one hand, the folding bed makes it easier to store, and on the other hand, it also facilitates portability.

To address the aforementioned issues, the prior art disclosure (application number: CN2022218154324) of a one-key folding bed was found after searching. The document describes that the one-key folding bed comprises a base, a bottom rod, a transmission rod, a pull rope, a sliding sleeve, a transmission connecting rod and a bottom foot; one end of the pull rope is connected to the transmission rod, the other end of the pull rope is connected to the sliding sleeve; the handrail joint is hinged between the two handrail tubes, one end of the traction wire is connected to the transmission connecting rod, and the other end of the traction wire is connected to the handrail joint. In the disclosed structure, the pull rope is used to successively pull the sliding sleeve, transmission connecting rod, traction wire, and handrail joint to achieve the unlocking of the handrail joint. However, due to the friction experienced by the pull rope during multiple traction processes, it is prone to breaking or losing its elasticity, which renders it unable to unlock the handrail joint and significantly affects the service life of the infant crib.

Therefore, the invention provides a one-handed folding bed.

3. SUMMARY OF THE INVENTION

To improve the effectiveness of the above technology, the invention aims to provide a bed that can be folded or unfolded by one-handed operation.

To achieve the above purpose, the invention has the following technical solutions: a one-handed folding bed comprises a bed frame main body enclosed by a peripheral framework; the bed frame main body comprises an upper frame, a lower frame, and intermediate upright poles supporting the upper frame and the lower frame; wherein the upper frame adopts a square frame enclosed by dual longitudinal rods with each side connected by foldable connectors to connect the four corners; the lower frame is provided with intersecting rods and a pull-up movable connector are connected between the intersecting rods.

The pull-up movable connector comprises an intermediate pull-up cavity, rotating snap-fit joints respectively connected to both sides of the intermediate pull-up cavity by rivets, and a movable lifting block provided in the intermediate pull-up cavity by springs and rivets.

The intermediate pull-up cavity is symmetrically provided with spring columns, springs are sleeved on the spring columns respectively; the outer wall of the intermediate pull-up cavity is provided with upper and lower shifting holes, long rivets are provided in the upper and lower shifting holes respectively and can move up and down in the upper and lower shifting holes respectively.

The top of the intermediate pull-up cavity is provided with a strap opening connected to the inner cavity.

The upper end of the rotating snap-fit joint is provided with grooves, the lower end of the rotating snap-fit joint is provided with rivet holes, and the sides of the rotating snap-fit joints are respectively provided with intersecting rod holders.

The movable lifting block is symmetrically provided with spring holes for receiving springs, the bottom of the movable lifting block is provided with gaps for rivets to pass through; the upper end of the movable lifting block is provided with a through hole for the strap to pass through and the through hole is connected to the gap, and the strap is passed through the through hole and fastened to the rivet.

Two intersecting rods on both sides of the foldable connectors are movably connected by rivets, and the surface of the foldable connector is provided with transverse slots and oblique slots for rivets to slide, and the ends of the oblique slots are locking slots.

The lower frame is also provided with front and rear frame rods, the front and rear frame rods are respectively connected to the intersecting rods through U-shaped connectors and rivets, and the front and rear frame rods can be folded with the intersecting rods.

The bottom of the intermediate upright pole is connected with a bottom connector respectively, and the intermediate upright poles are inserted into the bottom connector respectively; one end of the intersecting rod is also connected in the bottom connector by rivets respectively, and the intersecting rod can freely rotate and fold in the bottom connector.

The middle sections of the front and rear frame rods are connected with T-shaped connectors respectively, the front frame rods can be folded through the T-shaped connectors, and the rear frame rods can be folded through the T-shaped connectors.

Compared to the prior arts, the invention has the following advantages and beneficial effects:

The invention employs mechanical connectors for the fastening and unfastening process, with a simple structure and a rational design without rope actuation. During operation, the pull strap can be lifted by only one hand to drive the pull-up movable connector for unfastening, completing the folding operation with a smooth unfastening process and convenient one-handed action.

4. BRIEF DESCRIPTION OF ACCOMPANY DRAWINGS

Figure 1:
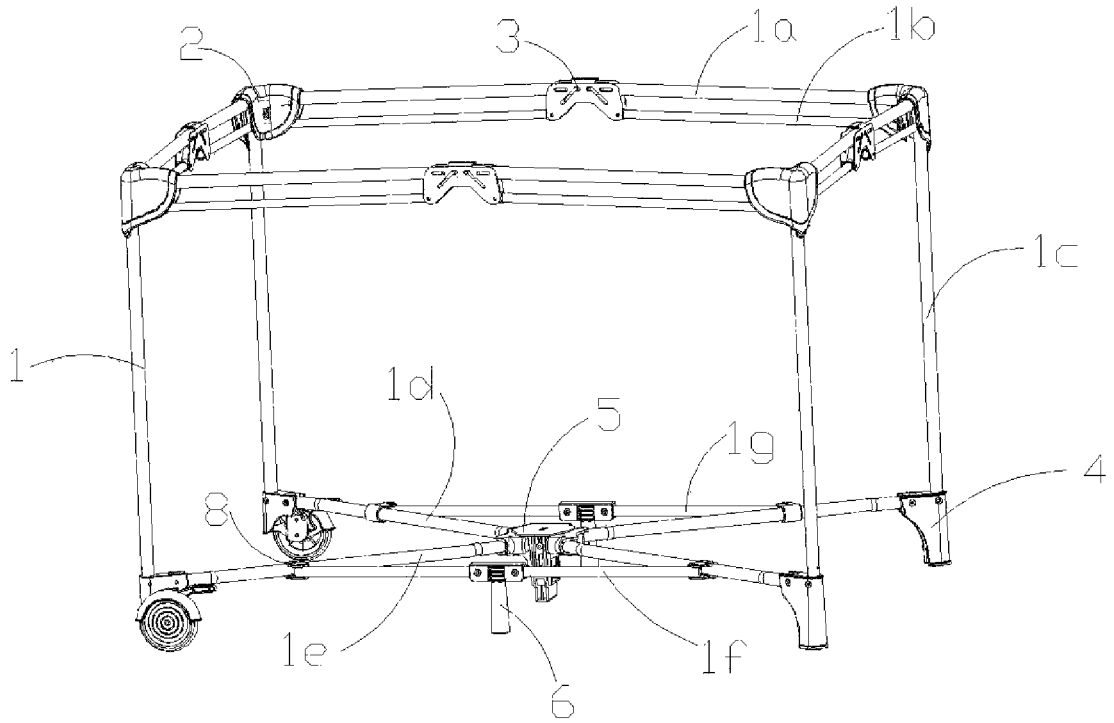
FIG. 1 is a schematic view showing the structure of the invention.

In the drawings: 1. bed frame main body; 2. corner brackets; 3. foldable connectors; 4. bottom connectors; 5. pull-up movable connector; 6. t-shaped connector; 7. pull strap; 8. u-shaped connector; 1*a*. longitudinal rod I; 1*b*. longitudinal rod II; 1*c*. intermediate upright poles; 1*d*. intersecting rod I; 1*e*. intersecting rod II; 1*f*. front frame rod; 1*g*. rear frame rod; 301. oblique slots; 302. transverse slots; 303. locking slots; 501. right rotating snap-fit joint; 502. movable lifting block; 503. springs; 504. intermediate pull-up cavity; 505. left rotating snap-fit joint; 506. lower long rivet; 507. upper long rivet; 502-1. spring holes; 502-2. through hole; 502-3. gap; 504-1. spring columns; 504-2. lower shifting hole; 504-3. upper shifting hole; 504-4. strap opening; 505-1. grooves; 505-2. rivet holes; 505-3. intersecting rod holders.

5. SPECIFIC EMBODIMENT OF THE INVENTION

To make the technical solutions provided by the invention more comprehensible, a further description of the invention is given below in combination with the attached drawings and embodiments, and the embodiments are exemplary and not the limitations of the scope of the disclosure. Apparently, the described drawings are merely some embodiments of the application rather than all the embodiments of the application. It should be understood that the application is not limited to the drawings described herein. Based on the drawings in the invention, all other drawings obtained by those of ordinary skill in the art without making creative labor fall within the scope of protection of the invention.

Figure 2:
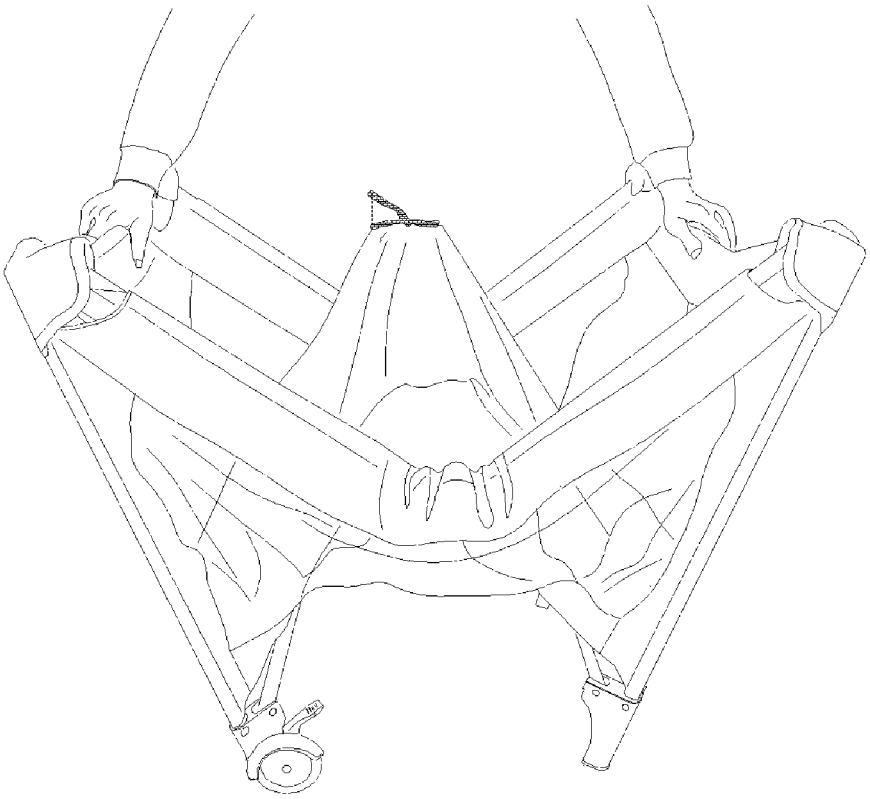
FIG. 2 is a schematic view showing the folding of the embodiment of the invention.

Referring to FIGS. 1-2, a one-handed folding bed comprises a bed frame main body 1 enclosed by a peripheral framework, wherein the bed frame main body 1 comprises an upper frame, a lower frame and intermediate upright poles 1*c* supporting between the upper frame and the lower frame; the intermediate upright poles 1*c* numbering four constitute a square folding bed, and the upper end of each intermediate upright pole 1*c* is provided on corner brackets 2 by riveting.

The upper frame adopts a quadrangular frame surrounded by double longitudinal rods, where the double longitudinal rods comprise longitudinal rod I 1*a* and longitudinal rod II 1*b;* one end of longitudinal rod I 1*a* and longitudinal rod II 1*b* are respectively provided in the corner brackets 2 by riveting, and the other end of longitudinal rod I 1*a* and longitudinal rod II 1*b* are respectively provided in the foldable connectors 3 by riveting; longitudinal rod I 1*a* and longitudinal rod II 1*b* are foldable by the effect of the foldable connectors 3.

The lower frame is provided with intersecting rods comprising intersecting rod I 1*d* and intersecting rod II 1*e,* and pull-up movable connectors 5 are connected between the intersecting rods; one end of intersecting rod I 1*d* and intersecting rod II 1*e* are respectively provided in the pull-up movable connectors 5, and the other end of intersecting rod I 1*d* and intersecting rod II 1*e* are provided on bottom connectors 4.

The lower frame is further provided with front frame rod 1*f* and rear frame rod 1*g;* the front frame rod 1*f* and the rear frame rod 1*g* are connected to the respective intersecting rods through U-shaped connectors 8 and riveting, and the front frame rod 1*f,* the rear frame rod 1*g* and intersecting rod I, II (1*d,* 1*e*) are rotatably foldable.

The middle sections of the front frame rod 1*f* and the rear frame rod 1*g* are respectively connected with T-shaped connectors 6; the front frame rod 1*f* are foldable through the T-shaped connectors 6, and the rear frame rod 1*g* are foldable through the T-shaped connectors 6.

Figure 5:
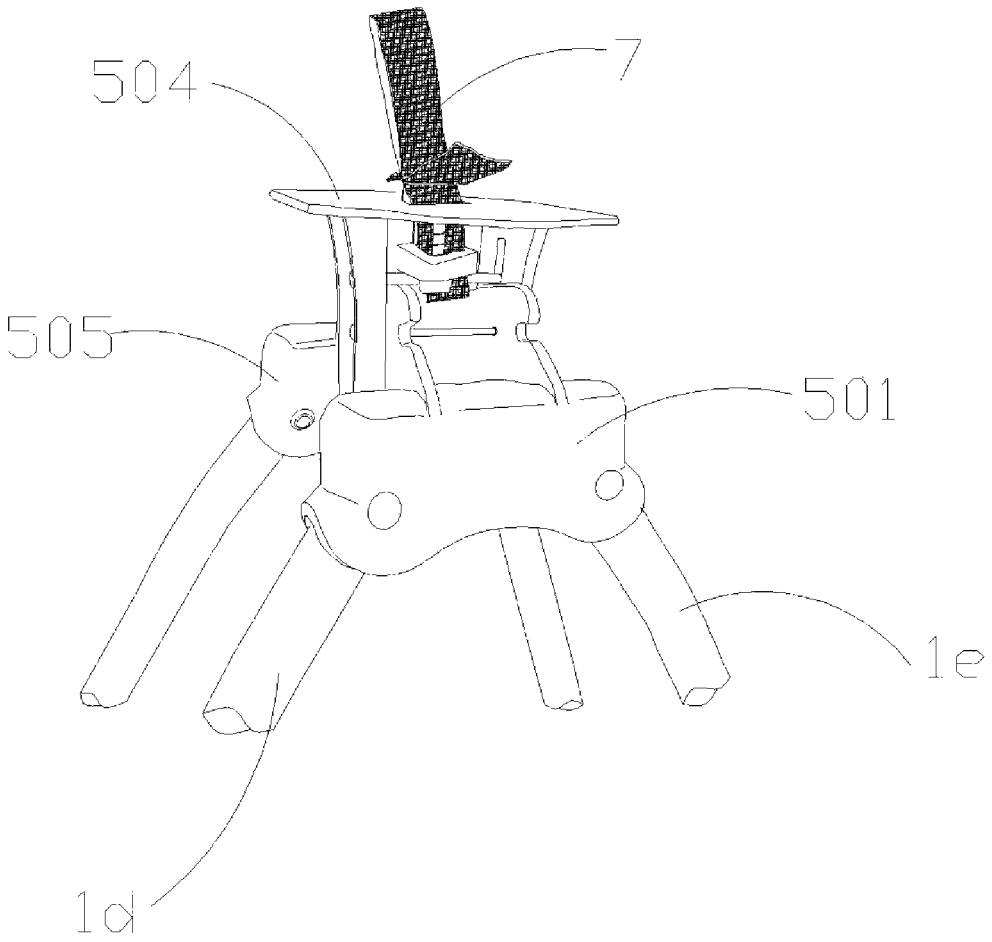
FIG. 5 is a schematic view showing the pull-up movable connector in the folded state of the invention.
Figure 6:
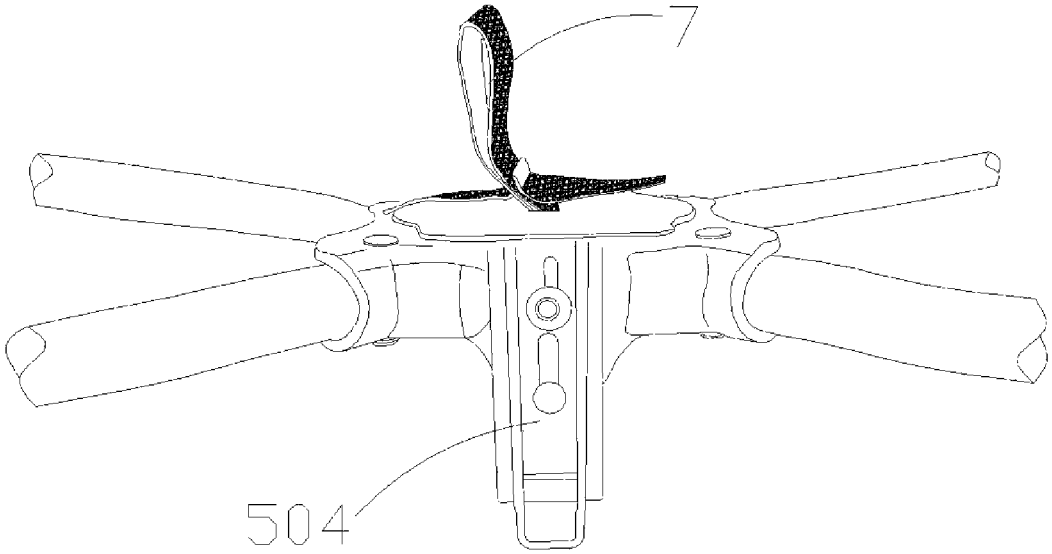
FIG. 6 is a schematic view showing the unfolded state of FIG. 5.
Figure 7:
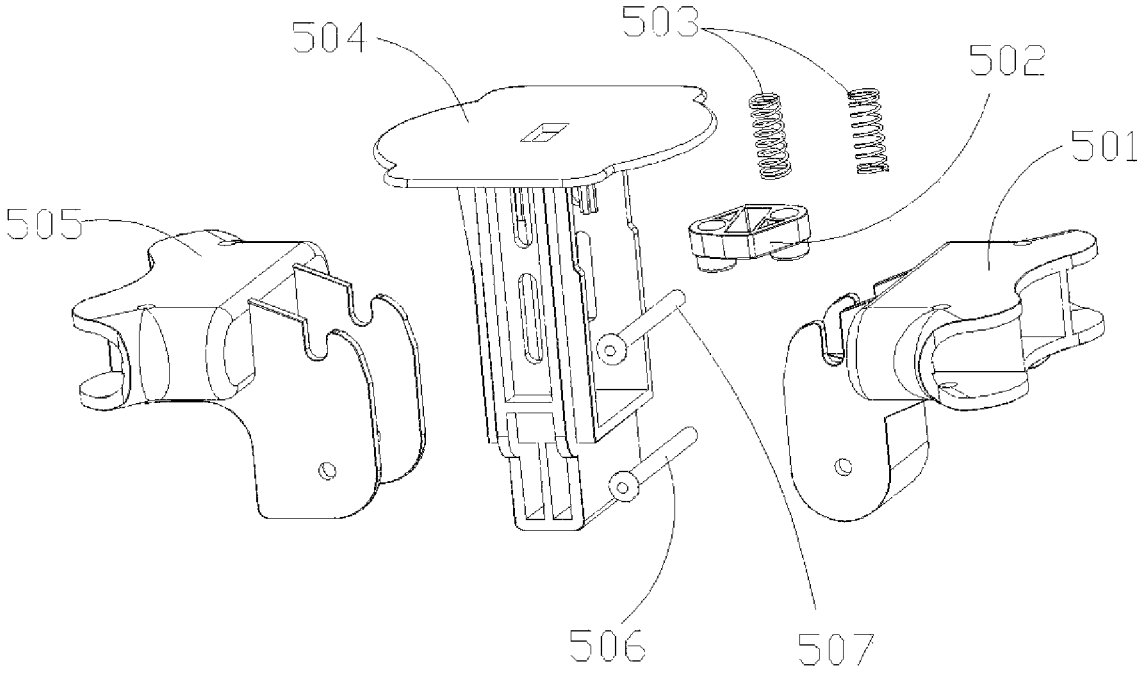
FIG. 7 is an exploded schematic view showing the pull-up movable connector.

Referring to FIGS. 5-7, the pull-up movable connector 5 comprises an intermediate pull-up cavity 504, rotating snap-fit joints (left rotating snap-fit joint 505, right rotating snap-fit joint 501 symmetrically provided at both sides of the intermediate pull-up cavity 504) respectively connected to both sides of the intermediate pull-up cavity 504 by riveting; and a movable lifting block 502 movably provided within the intermediate pull-up cavity 504 and mounted by springs 503 and upper long rivet 507; the pull strap 7 is tied on the upper long rivet 507, the upper long rivet 507 and movable lifting block 502 move upward within the intermediate pull-up cavity 504 by pulling the pull strap 7.

Figure 9:
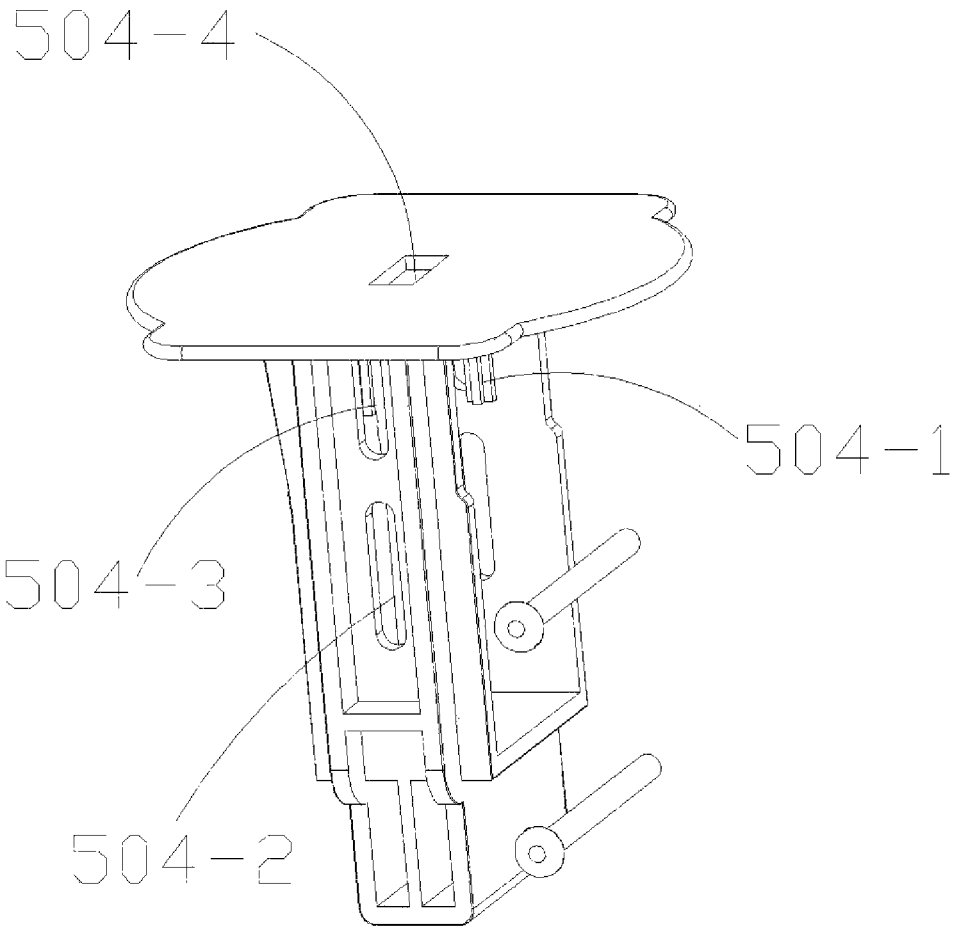
FIG. 9 is a schematic view showing the intermediate pull-up cavity of the pull-up movable connector.

As shown in FIG. 9, symmetrically provided within the intermediate pull-up cavity 504 are spring columns 504-1, and springs 503 are respectively socketed on the spring columns 504-1; the upper shifting hole 504-2 and lower shifting hole 504-3 are provided on the outer wall of the intermediate pull-up cavity 504; upper long rivet 507 and lower long rivet 506 are respectively provided within the upper shifting hole 504-2 and lower shifting hole 504-3; the long rivets can move up and down within the upper shifting hole 504-2 and lower shifting hole 504-3, respectively.

The top of the intermediate pull-up cavity 504 is provided with a strap opening 504-4 connected to the cavity, the pull strap 7 passes through the strap opening and is tightened on the upper long rivet 507 to pull.

Figure 8:
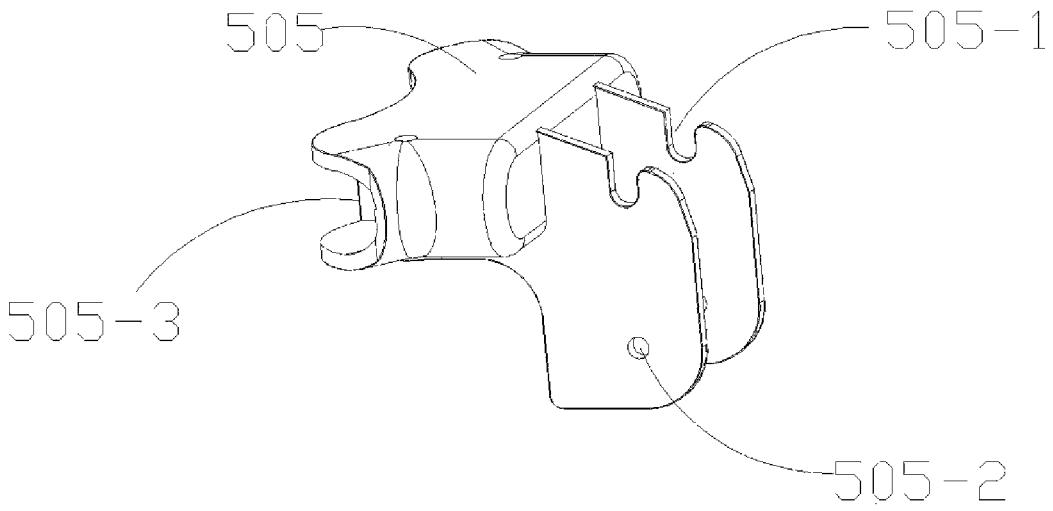
FIG. 8 is a schematic view showing the rotating clasp of the pull-up movable connector.

As shown in FIG. 8, the upper end of the rotating snap-fit joint 505 is provided with grooves 505-1; when the intermediate pull-up cavity 504 presses down, the grooves 505-1 snap and lock on the upper long rivet 507; when pulling the strap 7 and the intermediate pull-up cavity 504 pulls up, the upper long rivet 507 and lower long rivet 506 move up simultaneously, the left rotating snap-fit joint 505 and right rotating snap-fit joint 501 respectively rotate downward, at this moment the grooves 505-1 instantly disengage from the upper long rivet 507 to achieve the purpose of mutually folding the intersecting rods connected with the left and right rotating snap-fit joints.

The lower end of the rotating snap-fit joint 505 is provided with rivet holes 505-2, and the lower long rivet 506 is provided within the rivet hole 505-2; intersecting rod holders 505-3 are respectively provided at both sides of the rotating snap-fit joint 505. The lower long rivets 506 respectively connect the left rotating snap-fit joint 505 and right rotating snap-fit joint 501; when the left rotating snap-fit joint 505 and right rotating snap-fit joint 501 move up with the lower long rivets 506, the left rotating snap-fit joint 505 and right rotating snap-fit joint 501 respectively rotate outward.

Figure 10:
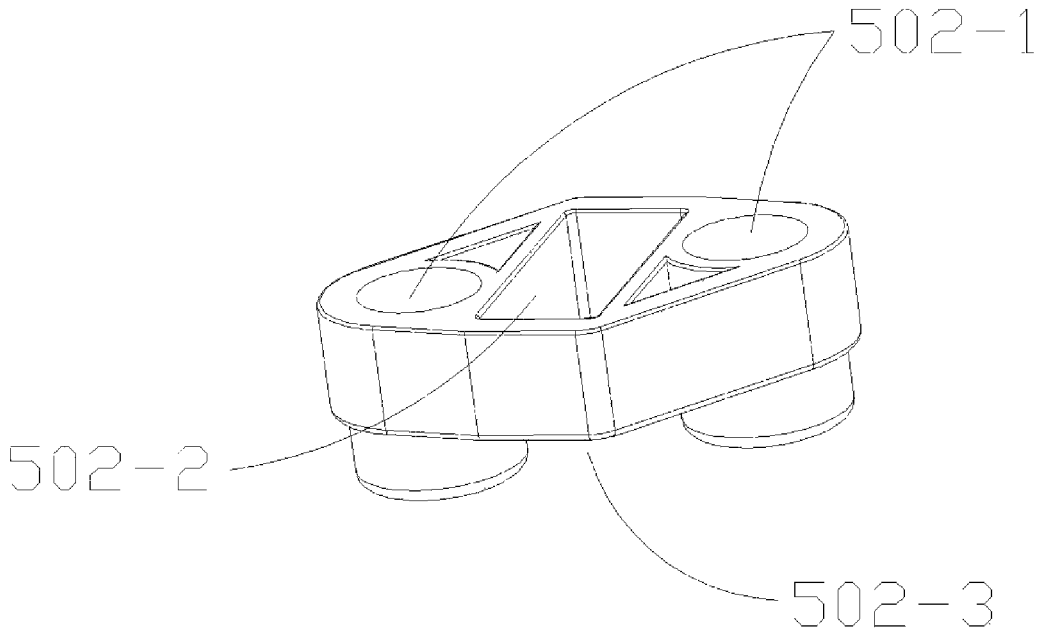
FIG. 10 is a schematic view showing the movable pull-up block of the pull-up movable connector.

Referring to FIG. 10, symmetrically provided on the movable lifting block 502 are spring holes 502-1 for loading springs 503; the bottom of the movable lifting block 502 is provided with a gap 502-3 for the upper long rivet 507 to pass through; the upper end of the movable lifting block 502 is provided with a through hole 502-2 for the pull strap 7 to pass through, the through hole 502-2 and the gap 502-3 are communicatively provided; the pull strap 7 passes through the through hole 502-2 and is tightened on the upper long rivet 507. When pulling the pull strap 7, the movable lifting block 502 and upper long rivet 507 move upward, compressing the springs 503.

Figure 3:
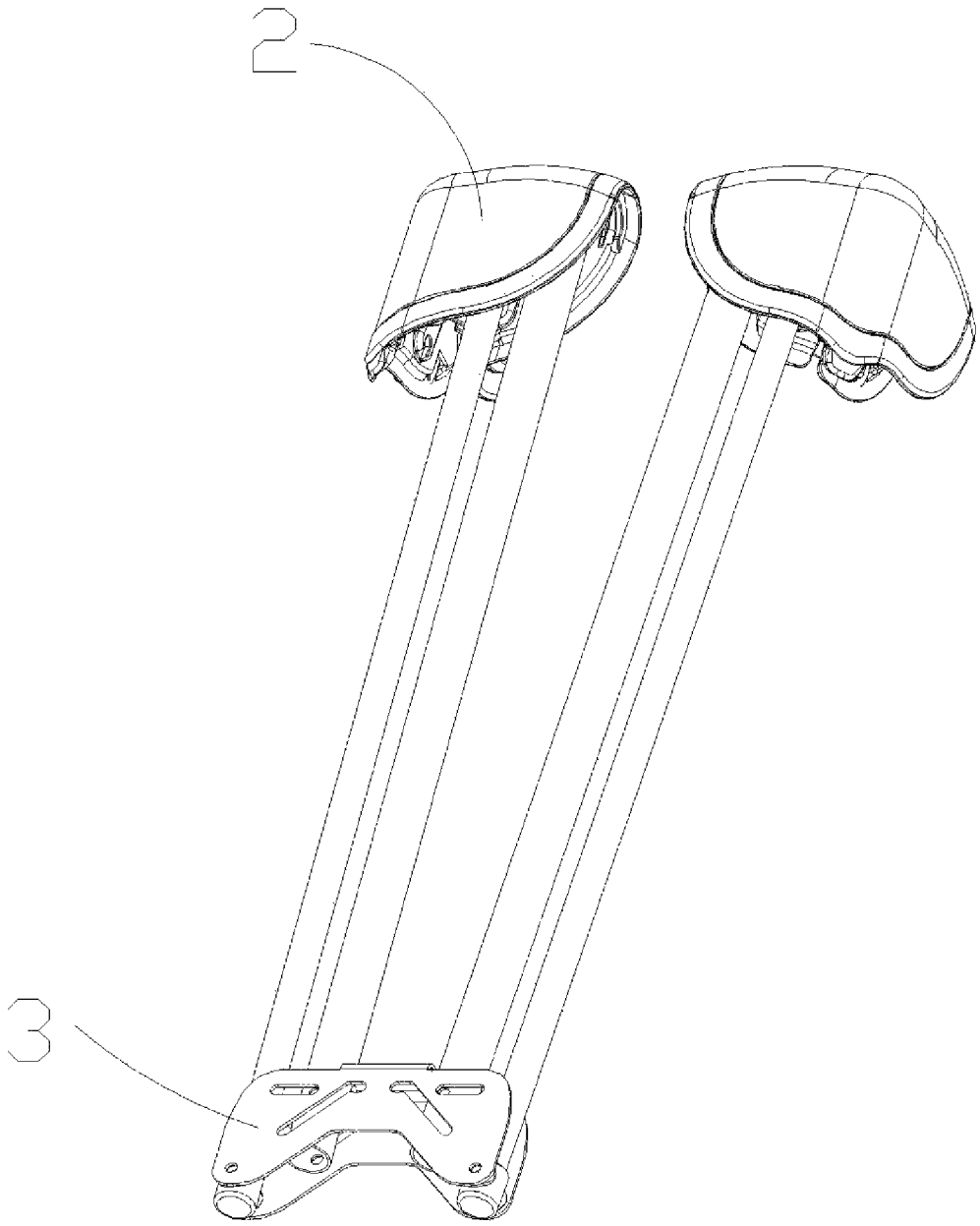
FIG. 3 is a schematic view showing the folding of a single double-rod of the upper frame of the invention.
Figure 4:
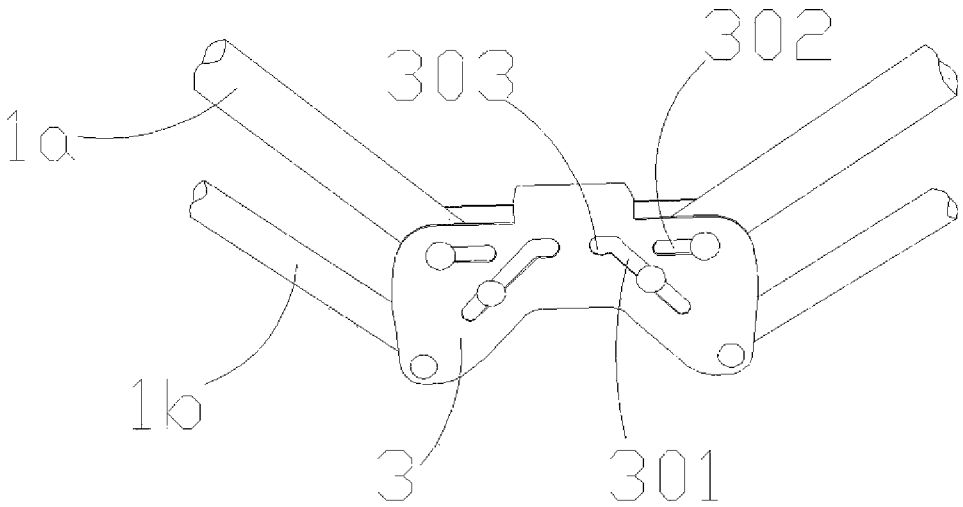
FIG. 4 is a schematic view showing the foldable connector of the invention.

As shown in FIGS. 3 and 4, the foldable connectors 3 have two longitudinal rods I and longitudinal rods II movably connected at both sides by riveting; the surface of the foldable connectors 3 is provided with straight slots 302 and oblique slots 301 for the rivets to slide; the end of the oblique slots 301 is provided with locking slots 303; the specific connection between the longitudinal rod I 1*a,* longitudinal rod II 1*b* and the foldable connectors 3 is as follows: the end of the longitudinal rod I 1*a* is connected to the foldable connectors 3 by two rivets, where one rivet slides in the straight slot 302, and the other rivet slides in the oblique slot 301, thus fully ensuring the folding of the longitudinal rod I 1*a;* and the longitudinal rod II 1*b* is connected to the foldable connector 3 by only one rivet.

The installation method of the pull-up movable connector of the invention is as follows: two springs 503 are respectively provided on the spring columns 504-1, and further the springs and the spring columns are respectively passed through the spring holes 502-1; the upper long rivet 507 is further passed inward from the upper shifting hole 504-3 provided on the outer wall of the intermediate pull-up cavity 504 and further inserted into the gap 502-3 provided at the bottom of the movable lifting block 502.

As shown in FIGS. 5-7, the installation method of the left rotating snap-fit joint 505 and right rotating snap-fit joint 501 of the invention with the intermediate pull-up cavity 504 is: the lower long rivet 506 is passed inward from the lower shifting hole 504-2 and further respectively inserted into the rivet holes 505-2 of the left rotating snap-fit joint 505 and right rotating snap-fit joint 501; the lower long rivet 506 drives the left rotating snap-fit joint 505 and right rotating snap-fit joint 501 to move up and down within the lower shifting hole 504-2; when the intermediate pull-up cavity 504 presses down to open the folding bed, the grooves 505-1 of the left rotating snap-fit joint 505 and right rotating snap-fit joint 501 lock on the upper long rivet 507; when pulling up the strap on the intermediate pull-up cavity 504, the pull strap 7 drives the upper long rivet 507 to move up, at this moment the grooves 505-1 instantly disengage from the upper long rivet 507 to unlock; at the same time, the lower long rivet 506 drives the left rotating snap-fit joint 505 and right rotating snap-fit joint 501 to move up and rotate downward to achieve the purpose of folding.

As shown in FIG. 2, the bed frame main body 1 can be used after being wrapped the soft fabric, it can be used; the two ends of the T-shaped connector 6 of the invention are movably connected with the front frame rod and rear frame rod by riveting to complete the folding process of the front frame rod and rear frame rod; the two ends of the foldable connector 3 are movably connected with two longitudinal rods by riveting to complete the folding process of the longitudinal rods of the upper frame; the corner brackets 2 respectively connect four longitudinal rods and intermediate upright poles; the two ends of the T-shaped connector respectively connect the front frame rod or rear frame rod to complete the folding process of the front frame rod and rear frame rod; the left rotating snap-fit joint 505 and right rotating snap-fit joint 501 provided at both sides of the pull-up movable connector 5 respectively connect the intersecting rods to complete the folding process of the intersecting rods; the other free end of the front frame rod or rear frame rod is riveted on the intersecting rod through the U-shaped connector 8, thereby completing the folding process between the intersecting rod and the front frame rod and rear frame rod; the other free end of the intersecting rod is movably connected to the bottom connector 4 by riveting to further complete the upward folding process of the intersecting rod. Therefore, when requiring the folding state, the operator could just pull the pull strap 7 upward to first complete the unfastening process of the intermediate pull-up cavity 504 and the left rotating snap-fit joint 505 and right rotating snap-fit joint 501, to easily fold the bed frame main body 1 as a whole. When requiring the unfolding state, the operator could press down the pull-up movable connector 5 so that the upper long rivet 507 in the intermediate pull-up cavity 504 snaps into the grooves 505-1 of the left rotating snap-fit joint 505 and right rotating snap-fit joint 501 to complete the fastening process, to fully expand the bed frame main body of the folding bed.

What is claimed is:

1. A one-handed folding bed comprises a bed frame main body and the bed frame main body comprises an upper frame, a lower frame, and intermediate upright poles supporting the upper frame and the lower frame, wherein the upper frame adopts a rectangular frame enclosed by dual longitudinal rods with each side connected by foldable connectors to connect four corners; and the lower frame is provided with intersecting rods and a pull-up movable connector and are connected between the intersecting rods; the pull-up movable connector comprises an intermediate pull-up cavity, rotating snap-fit joints respectively connected to both sides of the intermediate pull-up cavity by a first set of rivets, and a movable lifting block provided in the intermediate pull-up cavity by springs and the first set of rivets; an upper end of the rotating snap-fit joint is provided with grooves, a lower end of the rotating snap-fit joint is provided with rivet holes, and sides of the rotating snap-fit joints are respectively provided with intersecting rod holders, wherein the one-handed folding bed is configured to be placed in a folded state by an operator pulling upwards on the pull-up movable connector with one hand and the one-handed folding bed is configured to be placed in an unfolded state by the operator pressing downwards on the pull-up movable connector with one hand.

2. The one-handed folding bed as claimed in claim 1, wherein the intermediate pull-up cavity is symmetrically provided with spring columns, and the springs are sleeved on the spring columns respectively; an outer wall of the intermediate pull-up cavity is provided with upper and lower shifting holes, and wherein the first set of rivets are provided in the upper and lower shifting holes respectively and the first set of rivets are configured to move up and down in the upper and lower shifting holes respectively.

3. The one-handed folding bed as claimed in claim 1 wherein a top of the intermediate pull-up cavity is provided with a strap opening connected to the intermediate pull-up cavity.

4. The one-handed folding bed as claimed in claim 1, wherein the movable lifting block is symmetrically provided with spring holes for receiving springs, a bottom of the movable lifting block is provided with gaps for the first set of rivets to pass through; an upper end of the movable lifting block is provided with a through hole for a strap to pass through and the through hole is connected to at least one of the gaps, and the strap is passed through the through hole and fastened to at least one of the first set of rivets.

5. The one-handed folding bed as claimed in claim 1, wherein the dual longitudinal rods on both sides of the foldable connectors are movably connected by a second set of rivets, and a surface of the foldable connector is provided with transverse slots and oblique slots for the second set of rivets to slide, and ends of the oblique slots are locking slots.

6. The one-handed folding bed as claimed in claim 1, wherein the lower frame is also provided with front and rear frame rods, and the front and rear frame rods are configured to be folded with the intersecting rods.

7. The one-handed folding bed as claimed in claim 1, wherein a bottom of the intermediate upright pole is connected with a bottom connector respectively, and the intermediate upright poles are inserted into the bottom connector respectively; one end of each intersecting rod is also connected in the bottom connector by the first set of rivets respectively, and each one of the intersecting rods are configured to freely rotate and fold in the bottom connector.

8. The one-handed folding bed as claimed in claim 6, wherein middle sections of the front and rear frame rods are connected with T-shaped connectors respectively, the front frame rods are configured to be folded through the T-shaped connectors, and the rear frame rods are configured to be folded through the T-shaped connectors.

* * * * *